US005114243A

United States Patent [19]

Thier

[11] Patent Number: 5,114,243

[45] Date of Patent: May 19, 1992

[54] PACKAGE

[75] Inventor: Hubert Thier, Crystal Lake, Ill.

[73] Assignee: Sengewald/USA, Inc., Marengo, Ill.

[21] Appl. No.: 656,475

[22] Filed: Feb. 15, 1991

[51] Int. Cl.[5] ..... B65D 27/20

[52] U.S. Cl. ..... 383/85; 383/88; 383/95

[58] Field of Search ..... 383/85, 88, 95

[56] References Cited

U.S. PATENT DOCUMENTS

| | | | |
|---|---|---|---|
| 1,310,288 | 7/1919 | Nico | 383/88 |
| 1,310,289 | 7/1919 | Nico | 383/88 |
| 1,359,856 | 11/1920 | Anderson | 383/88 |
| 2,463,302 | 3/1949 | Orchard | 383/88 |
| 2,499,436 | 3/1950 | Whitfield | 383/95 |
| 2,669,382 | 2/1954 | Poppe | 383/95 |
| 2,686,004 | 8/1954 | Reiss | 383/88 |
| 3,126,146 | 3/1964 | Bonsor | 383/88 |
| 3,641,189 | 2/1972 | Widenback | 383/88 |

*Primary Examiner*—Gary E. Elkins
*Attorney, Agent, or Firm*—Foley & Lardner

[57] ABSTRACT

A package having an openable end, and a closure structure for closing the openable end. The closure structure comprises at least one aperture-set which includes a respective aperture in each of at least two sheet segments of the package. Each aperture has a tab which presents a free end depending within its respective aperture from a flex line. The flex line partially bounds the respective aperture, and respective apertures in each aperture-set are generally adjacently registrable in a covered position. The at least two sheet segments are held in the covered position by displacing the distal end of the tab associated with each respective aperture of an aperture-set through at least the next adjacent respective aperture of the aperture-set.

9 Claims, 5 Drawing Sheets

PACKAGE

BACKGROUND OF THE INVENTION

The present invention is directed to a package, and in particular to a flexible package for holding food items.

Certain food items, such as dry cereals, are presently packaged for distribution to consumers in chipboard (i.e,. non-corrugated cardboard) boxes with an interior paper bag-like package within which the dry cereal is contained. The interior paper package has a one-time peelable seal near its top so that a consumer may peelably open the top of the interior paper package to gain access to the enclosed cereal. The chipboard box is generally provided with four flaps which, when folded in the correct configuration, accommodate insertion of a tab on one of the four flaps within a slot in an opposing of the four flaps to maintain the top of the box in a closed position. Slipping the tab of the one flap from engagement with the slot presented in the opposing flap allows easy opening of the top of the box to gain access to the interior paper package and, thence, to the cereal contained within that paper package.

Packaging of such foodstuffs as dry cereals in a flexible, generally pouch-like, package without an exterior chipboard box would reduce the cost of packaging of such foodstuffs. Savings would be realized by eliminating the materials employed in constructing the chipboard box, as well as by eliminating the need for printing of the exterior chipboard box to identify the products contained within. Printing costs associated with applying labeling to flexible packaging are significantly less than such costs associated with chipboard boxes.

If such a flexible package is used for delivering foodstuffs to consumers, a method of temporarily maintaining the package in a closed position after it has initially been opened to gain access to its contents is a necessity.

Accordingly, the present invention provides a package having a closure structure appropriate for temporarily maintaining the package in a closed position while affording easy access to and reclosing of the package for its normal employment. Thus, the package of the present invention allows a user to repeatedly gain access to the contents of the package while preventing spilling of the package when it is stored.

SUMMARY OF THE INVENTION

The invention is a package comprising at least one wall which defines a well having an openable end, and a closure structure for closing the openable end. The openable end is bounded by at least one generally flexible sheet which is extendable across the openable end to a covered position, which covered position presents at least two sheet segments of the at least one sheet in substantially adjacent facing relationship across a generally planar expanse. The closure structure comprises at least one interference-fit structure within the expanse established by the at least two sheet segments in the covered position. Each interference-fit structure comprises an aperture-set which includes a respective aperture in each of the at least two sheet segments.

Each aperture has a tab structure for effecting an interference fit in the closed position, which tab structure presents a free distal end depending within its respective aperture from a flex line. The flex line partially bounds the respective aperture, and respective apertures in each aperture-set are generally adjacently registrable in the covered position.

Each interference-fit structure is configured to hold the at least two sheet segments in the covered position by displacing the distal end of the tab structure associated with each respective aperture of an aperture-set in a first direction generally laterally to the sheets in the covered position through at least the next adjacent respective aperture of the aperture-set.

In its preferred embodiment, the package is integrally formed as a generally flexible pouch which, in the covered position, presents two facing sheet segments in substantially adjacent facing relationship. In an alternate embodiment, the pouch may be formed as a gusseted pouch, in which case the covered position presents folded gussets, each presenting two gusset-panels sandwiched between the two sheet segments for an expanse at the edges of the two sheet segments in the covered position. In this alternate embodiment, there may be provided a plurality of apertures in register through the two sheet segments and a plurality of apertures in register through the sandwiched gusset panels at the edges of the two sheet segments in the covered position.

In order to provide an enhanced interference fit for maintaining the package in its covered position, other embodiments of the present invention provide that the flex line from which the respective tab structure of a first aperture depends in a first sheet segment is offset from the flex line from which the tab structure of a second aperture in a second sheet segment depends so that displacement of a first tab structure through a second aperture presents an extension of the first tab beyond the edge of the second aperture, thereby enhancing the interference fit provided by the first tab in its extending through the second aperture. A similar effect may be realized by maintaining the flex line of a first aperture substantially in register with the flex line of a second aperture while providing that the tab of the first aperture be of greater length from its respective flex line than such length of the tab of the second aperture, thereby also providing that the first tab extends beyond the edge of the second aperture when inserted therethrough to enhance the interference fit thus established.

Of course, a combination of displacing the flex line and providing a longer tab in the first aperture will also establish the same enhanced interference-fit effect.

In yet another alternate embodiment of the present invention, a crease line is provided at the top of the package to facilitate folding of the sheet segments in an enhanced covered position. In this alternate embodiment, a plurality of first apertures and their respective depending first tabs is provided in the original meeting of the two sheet segments, and a plurality of second apertures and their respective depending second tabs is provided in the folded portion of the two sheet segments, thereby providing four apertures and their respective depending tabs for cooperating to establish an interference fit to maintain the enhanced closed position.

In a gusseted version of this alternate embodiment having a crease line, a total of eight apertures and their respective depending tabs will be presented in the area where the gusset panels are sandwiched between the two sheet segments to provide an enhanced covered position when the sheets and their sandwiched gusset panels are folded over at the crease line.

It is, therefore, an object of the present invention to provide a package which is economical to produce and provides an effective closure structure for maintaining the package in a temporarily closed orientation which enables easy access to the package contents and facilitates repeated reclosing.

Further objects and features of the present invention will be apparent from the following specification and claims when considered in connection with the accompanying drawings illustrating the preferred embodiments of the invention.

DETAILED DESCRIPTION OF THE DRAWINGS

DETAILED DESCRIPTION OF THE INVENTION

Figure 1:
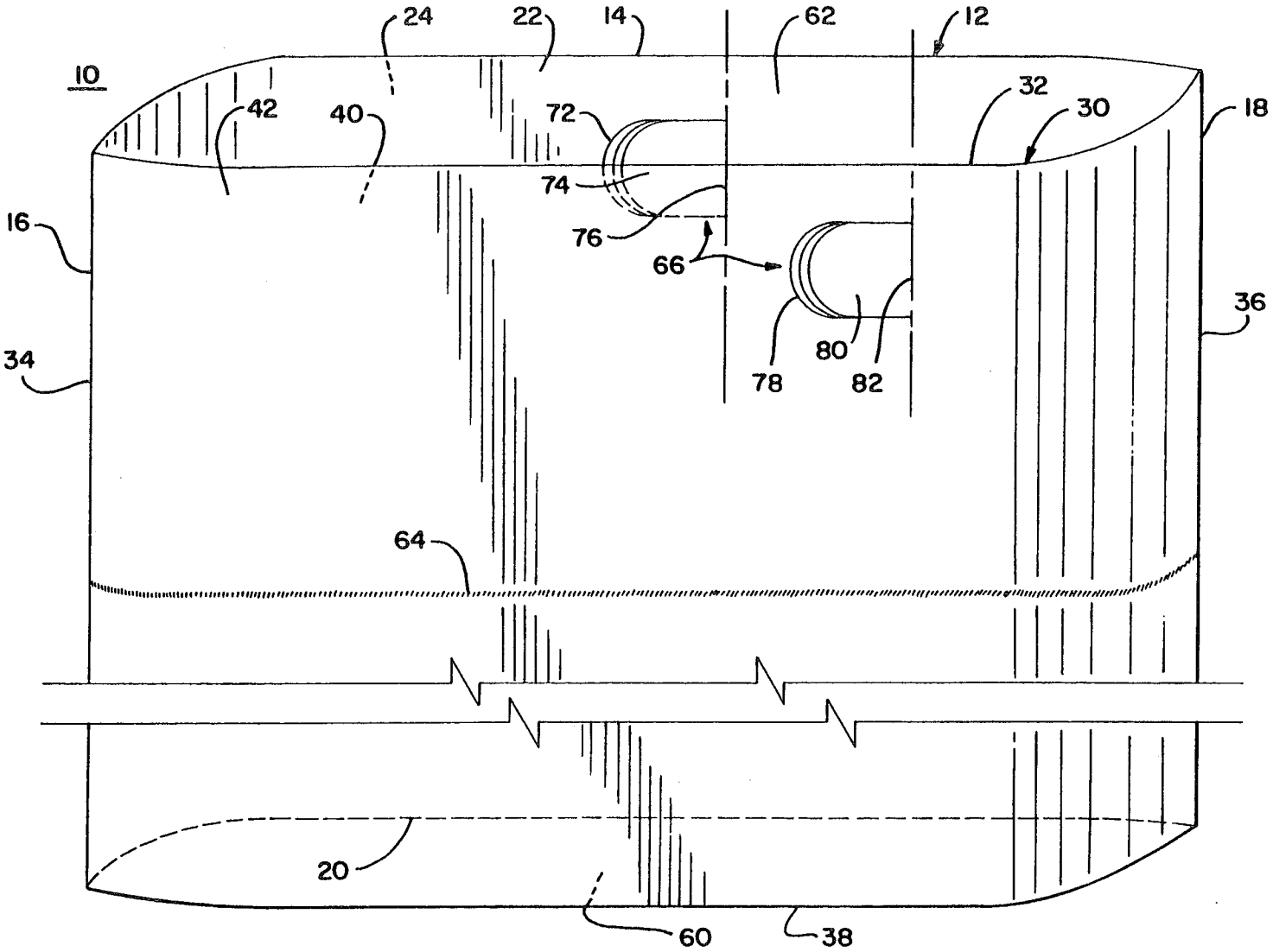
FIG. 1 is a perspective view of a first embodiment of the present invention.

Referring to FIG. 1, a perspective view of a package 10 is presented. Package 10 is comprised of a first wall 12 having a top edge 14, a first side edge 16, a second side edge 18, a bottom edge 20, an inner face 22, and an outer face 24. A second wall 30 has a top edge 32, a first side edge 34, a second side edge 36, a bottom edge 38, an inner face 40 and an outer face 42.

First wall 12 and second wall 30 are joined at their respective first side edges 16, 34 and their respective second side edges 18, 36.

Package 10 has a bottom 60 which is preferably integrally formed with first wall 12 and second wall 30 to present a well 62 for receiving contents.

FIGS. 1-4 illustrate various embodiments of package 10 in a discontinuous manner, indicating that the height of the illustrated packages is not limited and that the proportions illustrated in FIGS. 1-4 are not intended to restrict the scope of the present invention in any way.

For example, the portion of FIG. 1 above the discontinuity could represent an attachment to the top of a chipboard box (not shown in FIG. 1) to provide a closure structure for such a box.

Package 10 is preferably flexible and constructed of a unitary multi-layer construction. Such unitary multi-layer construction could, for example, comprise a polypropylene outer layer, a plastic or paper intermediate layer, and a peelable polyethylene inner layer. In such a configuration, a sealing line 64 may be provided to seal first wall 12 with second wall 30 for shipment of goods within well 62 to a consumer. The peelable polyethylene interior layer of the unitary multi-layer construction would facilitate a peeling open of package 10 along sealing line 64. Subsequent reclosing of package 10 would be effected by the closure structure of package 10.

Still referring to FIG. 1, a closure structure comprising interference-fit structure 66 is illustrated. Interference-fit structure 66 is comprised of a first aperture 72 in first wall 12 and an associated depending tab 74 disposed within first aperture 72 from a flex line 76. Interference-fit structure 66 further includes a second aperture 78 in second wall 30. Disposed within second aperture 78 is a depending tab 80 which depends from a flex line 82.

Package 10 preferably includes as its closure means at least one interference-fit structure 66. Any additional interference-fit structures 66 would be arrayed (if employed) along a line generally parallel with sealing line 64. When package 10 is in a closed position, first wall 12 is in substantial adjacent facing relation with second wall 30, and inner face 22 substantially abuts inner face 40.

An interference fit may be established between apertures 72, 78 in the closed position with inner faces 22, 40 in facing relation. The interference fit is effected by displacing tab 74 obliquely to first wall 12 toward second wall 30 sufficiently to urge tab 74 through aperture 78, displacing tab 80 in the process. Release of the interference-fit is easily effected by urging tabs 74, 80 in the opposite direction, from second wall 30 toward first wall 12, while spreading walls 12, 30 to open package 10.

In the interest of facilitating understanding of the present invention, like elements will be identified by the same reference numerals in the various drawings.

Figure 2:
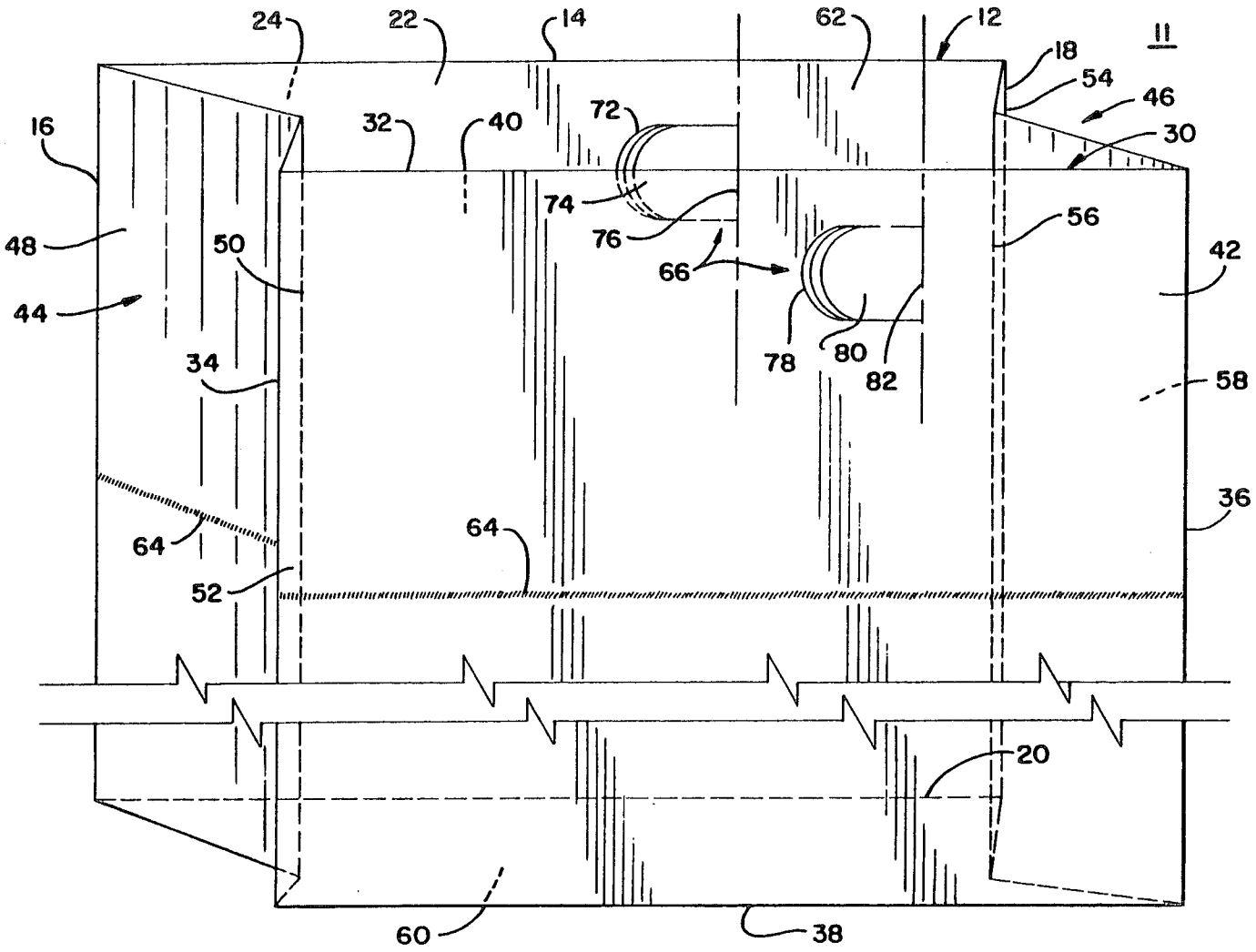
FIG. 2 is a perspective view of a second embodiment of the present invention.

FIG. 2 is a perspective view of a second embodiment of the present invention.

In FIG. 2, a package 11 is comprised of a first wall 12 having a top edge 14, a first side edge 16, a second side edge 18, a bottom edge 20, an inner face 22, and an outer face 24. A second wall 30 has a top edge 32, a first side edge 34, a second side edge 36, a bottom edge 38, an inner face 40 and an outer face 42.

First wall 12 and second wall 30 are joined by a gusset 44 joining first side edges 16, 34 and a gusset 46 joining second side edges 18, 36. Gusset 44 is a unitary structure presenting a first gusset panel 48 extending from first side edge 16 to a fold line 50 and a second gusset panel 52 extending from fold line 50 to second side edge 34. Similarly, gusset 46 is a unitary structure presenting a first gusset panel 54 extending from second side edge 18 to a fold line 56 and a second gusset panel 58 extending from fold line 56 to second side edge 36.

First wall 12, second wall 30, and gussets 44, 46 are preferably flexible and constructed of a unitary multi-layer construction, as previously described in connection with FIG. 1.

As in the above-described first embodiment, interference-fit structure 66 is comprised of a first aperture 72 in first wall 12 having an associated depending tab 74 disposed from a flex line 76. Interference-fit structure 66 further includes a second aperture 78 in second wall 30. Disposed within second aperture 78 is a depending tab 80 which depends from a flex line 82.

In this second embodiment of the present invention, package 11 includes as its closure means at least one interference-fit structure 66 intermediate the reaches of gussets 44, 46 inward from first edges 16, 34 and second edges 18, 36 when package 11 is in a closed position with first wall 12 in substantial adjacent facing relation with second wall 30 having inner face 22 substantially abutting inner face 40. In the closed position, gusset panels 48, 52 and gusset panels 54, 58 are sandwiched between first wall 12 and second wall 30.

Figure 3:
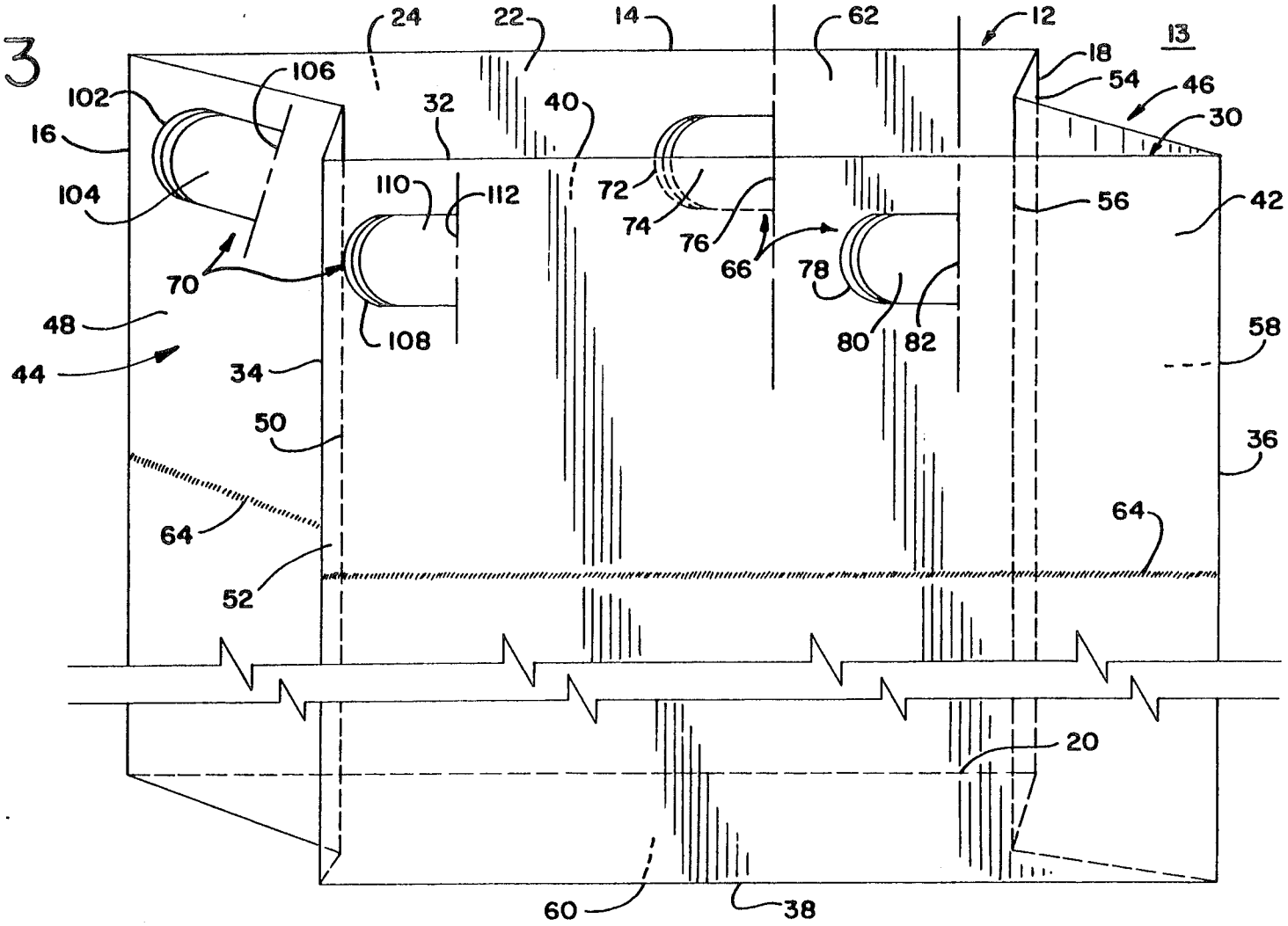
FIG. 3 is a perspective view of a third embodiment of the present invention.

FIG. 3 is a perspective view of a third embodiment of the present invention.

In FIG. 3, a package 13 has a first wall 12 and second wall 30 joined by a gusset 44 joining first side edges 16, 34 and gusset 46 joining second side edges 18, 36. Gusset 44 presents a gusset panel 48 extending from first side edge 16 to a fold line 50 and a second gusset panel 52 extending from fold line 50 to second side edge 34. Similarly, gusset 46 presents a first gusset panel 54 extending from second side edge 18 to a fold line 56 and a second gusset panel 58 extending from fold line 56 to second side edge 36.

Interference-fit structures 66 and 70 are illustrated. Interference-fit structure 66 is constructed as previously described in connection with the first and second embodiments of the present invention.

Interference-fit structure 70 is associated with gusset 44 and includes an aperture and tab structure in first wall 12 (not shown) substantially of the same construction as other aperture-and-tab structures of interference-fit structure 70, and an aperture 102 in first gusset panel 48 with a depending tab 104 disposed within aperture 102 depending from a flex line 106. Interference-fit structure 70 further includes a similar aperture and depending tab situated in second gusset panel 52 (not shown) and an aperture 108 with a depending tab 110 disposed therein from a flex line 112.

When package 13 is closed with gusset panels 48, 52 compressively sandwiched between first wall 12 and second wall 30, the various apertures of interference-fit structure 70 are generally in register to facilitate a displacement of tabs obliquely to the walls 12, 30 and through adjacent apertures of interference-fit structure 70 to effect an interference-fit among first wall 12, gusset panels 48, 52, and second wall 30 in a manner substantially the same as previously described in connection with interference-fit structure 66. Thus, in the case of interference-fit structures associated in register with gusset panels, of which interference-fit structure 70 is an example, four apertures are involved rather than the two apertures required intermediate the reach of gusset panels in the closed position.

Figure 4:
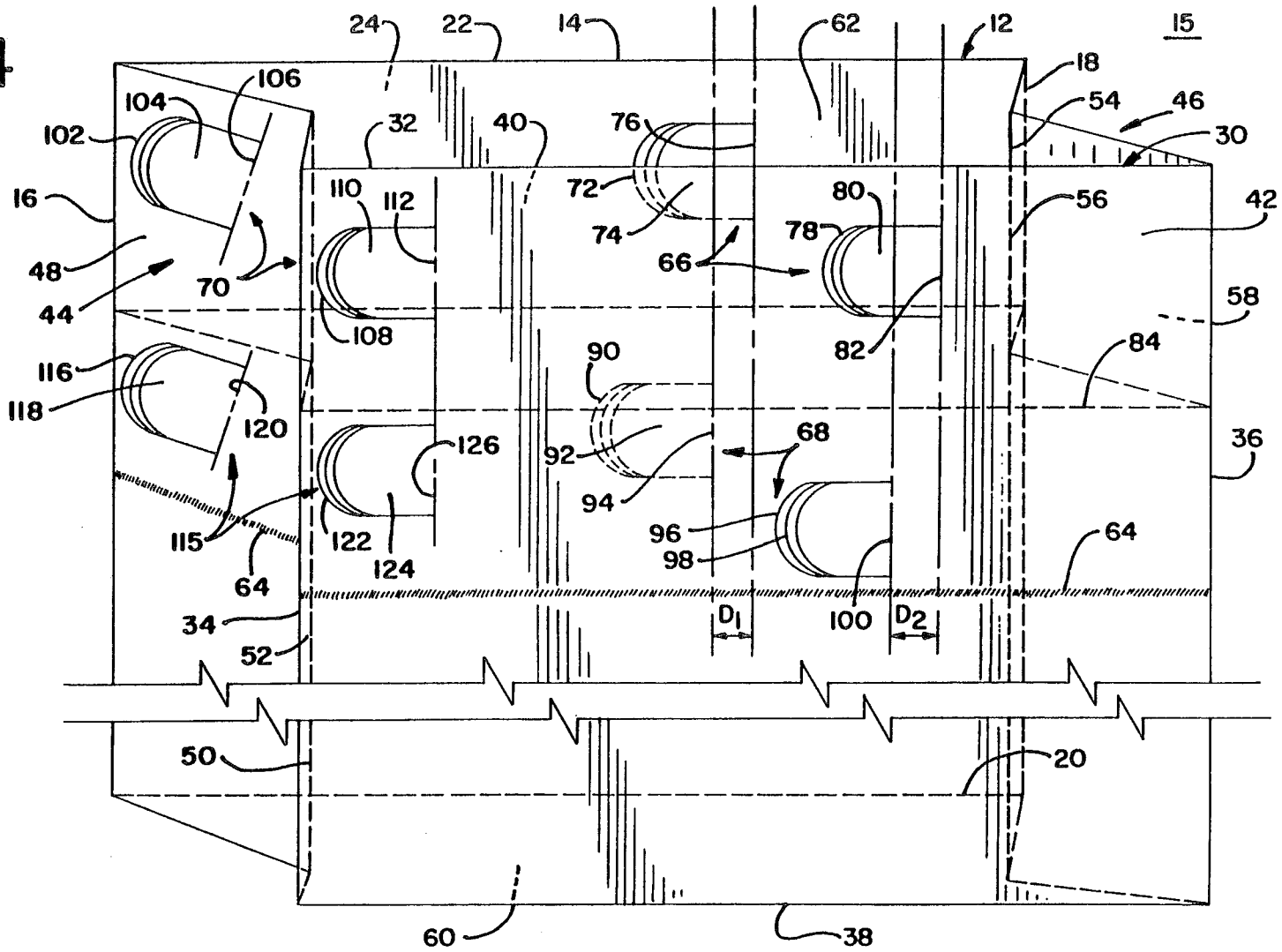
FIG. 4 is a perspective view of the preferred embodiment of the present invention.

FIG. 4 is a perspective view of the preferred embodiment of the present invention.

In FIG. 4, a package 15 has a first wall 12 and second wall 30 connected by a gusset 44 joining first side edges 16, 34 and a gusset 46 joining second side edges 18, 36. Gusset 44 presents a gusset panel 48 extending from first side edge 16 to a fold line 50 and a second gusset panel 52 extending from fold line 50 to second side edge 34. Similarly, gusset 46 presents a first gusset panel 54 extending from second side edge 18 to a fold line 56 and a second gusset panel 58 extending from fold line 56 to second side edge 36.

First wall 12, second wall 30, and gussets 44, 46 are preferably flexible and constructed of a unitary multi-layer construction as previously described in connection with FIG. 1 in describing the first embodiment of the present invention. A sealing line 64 is provided to seal all of first wall 12, second wall 30, and gussets 44, 46 for shipment of goods within well 62 to a consumer. The peelable polyethylene interior layer of the unitary multi-layer construction facilitates a peeling open of package 15 along sealing line 64. Subsequent reclosing of package 15 would be effected by the closure structure of package 15.

A closure structure comprising interference-fit structures 66, 68, and 70 is illustrated. Interference-fit structure 66 is comprised of a first aperture 72 in first wall 12 and an associated depending tab 74 disposed within first aperture 72 from a flex line 76. Interference-fit structure 66 further includes a second aperture 78 in second wall 30. Disposed within second aperture 78 is a depending tab 80 which depends from a flex line 82.

Package 15 includes a crease line 84 for facilitating folding to an enhanced closed position in which inner face 22 remains in adjacent facing relation with inner face 40 while outer face 42 is folded to an adjacent facing relation with itself. In such an enhanced closed position, interference-fit structure 66 is in register with interference-fit structure 68 to facilitate establishing an interference fit. Interference-fit structure 68 includes an aperture 90 having depending therein a tab 92 depending from a flex line 94 which partially borders aperture 90 and an aperture 96 having depending therein a tab 98 depending from a flex line 100 which partially borders aperture 96.

An interference fit may be established in the enhanced closed position among the various apertures 72, 78, 90, 96, by displacing tab 92 toward second wall 30 sufficiently to urge tab 92 through apertures 96, 78, and 72. Tab 92 displaces succeeding tab 98 to extend through apertures 78, 72, displaces tab 80 to extend through aperture 72, and displaces tab 74 in the process of such urging.

Release of the interference fit is easily effected by urging the various tab structure in the opposite direction, from second wall 30 toward first wall 12, while spreading walls 12, 30 to open package 15.

Package 15 includes as its closure means an array of at least one interference-fit structure 66 and a corresponding array of at least one interference-fit structure 68, additional interference-fit structures 66, 68 being arrayed (if employed) intermediate the reaches of gussets 44, 46 inward from first edges 16, 34 and second edges 18, 36 when package 15 is in a closed position.

To further enhance the interference-fit established by interference-fit structures 66, 68, flex line 94 may be displaced from flex line 76 a distance $D_1$, and flex line 100 may be displaced from flex line 82 a substantially equal distance $D_2$. In such a configuration, when an interference fit is established by displacing each respective tab through its next adjacent aperture, as described above, tabs 92, 98 will extend beyond apertures 78, 72. Alternatively, an enhanced interference fit may be established if flex lines 76, 94 and flex lines 82, 100 are generally in register, and the length of displacement of tabs 92, 98 from their respective flex lines 94, 100 being greater than the length of displacement of respective tabs 74, 80 from their respective flex lines 76, 82. With such structure, an enhanced interference fit will present tabs 92, 98 extending beyond apertures 72, 78. Of course, a combination of displacing flex lines and varying lengths of tabs may also be employed to yield such an enhanced interference fit.

Interference-fit structures 70, 102 are associated with gusset 44. Thus, interference-fit structure 70 includes an aperture and an associated tab in first wall 12 (not shown), and an aperture 102 in first gusset panel 48 with a depending tab 104 disposed within aperture 102 depending from a flex line 106. Interference-fit structure 102 also includes a similar aperture and depending tab situated in second gusset panel 52 (not shown) and an aperture 108 with a depending tab 110 disposed therein from a flex line 112.

When package 15 is closed with gusset panels 48, 52 sandwiched between first wall 12 and second wall 30, the various apertures of interference-fit structure 70 are generally in register to facilitate a displacement of tabs obliquely to walls 12, 30 and through adjacent apertures of interference-fit structure 70 to effect an interference fit among first wall 12, gusset panels 48, 52, and second wall 30 in a manner substantially as previously described in connection with interference-fit structures 66, 68. Thus, in the case of interference-fit structures associated with gusset panels, four apertures are involved, rather than two apertures as is the case in areas of package 15 not involving gusset panels. If the enhanced closed position involving crease line 84 is contemplated with regard to a gusset panel area in the closed position of package 15, then eight apertures are involved in effecting an interference-fit involving gusset panels. In such case, interference-fit structure 115, having four apertures, including apertures 116, 122, and four associated respective tabs, including tabs 118, 124, depending from four respective flex lines, including flex lines 120, 126, would participate in establishing the interference fit.

Of course, enhancement of the interference fit by displacing flex lines by varying lengths of tabs, or by both such structural variations, is possible with the preferred embodiment of FIG. 4.

Figure 5:
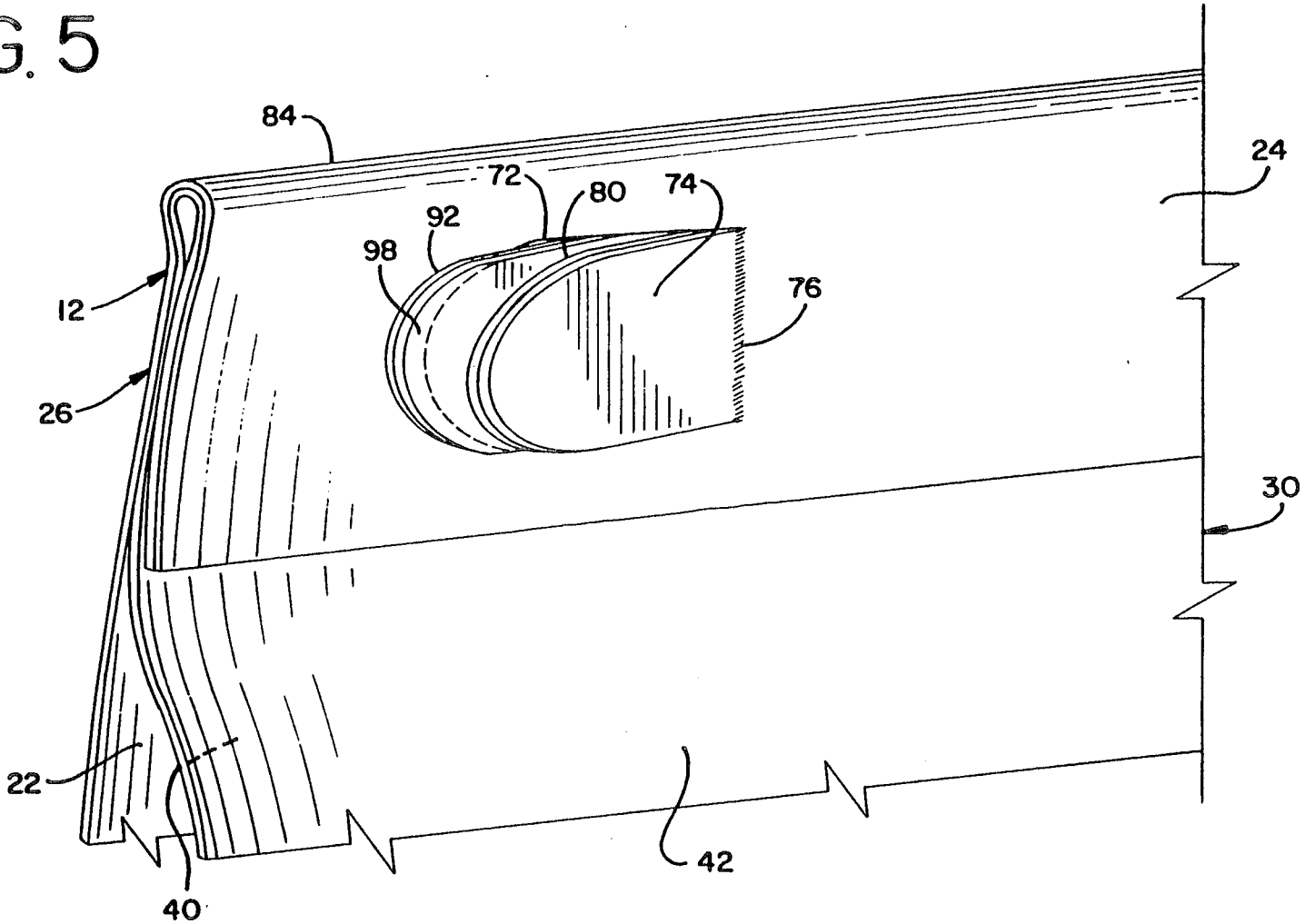
FIG. 5 is a detailed partial perspective illustration of the preferred embodiment of the present invention.

FIG. 5 is a detailed partial perspective illustration of the preferred embodiment of the present invention.

In FIG. 5, first wall 12 is illustrated in generally adjacent facing relation with second wall 30 with inner face 22 generally abutting inner face 40 across an expanse 26. First wall 12 and second wall 30 are folded at crease line 84 to present inner face 42 in general adjacent abutting relation with itself. Tabs 92, 98, 80, 74 are illustrated as having been displaced obliquely to walls 12, 30 from first wall 12 toward second wall 30 sufficiently to extend tabs 92, 98, 80 through aperture 72, and thereby also displacing tab 74 outwardly of outer face 24 along its flex line 76. Tabs 92, 98 extend beyond aperture 72 to establish an enhanced interference fit. Such extension of tabs 92, 98 beyond aperture 72 may be effected by providing a longer length of displacement of tabs 92, 98 from their respective flex lines 94, 100 (not shown in FIG. 5), or by displacing flex lines 94, 100 from flex lines 76, 82, or by a combination of a longer length for respective tabs 92, 98 and appropriate displacement of flex lines.

It is to be understood that, while the detailed drawings and specific examples given describe preferred embodiments of the invention, they are for the purpose of illustration only, that the apparatus of the invention is not limited to the precise details and conditions disclosed and that various changes may be made therein without departing from the spirit of the invention which is defined by the following claims:

I claim:

1. A package comprising:

at least one wall defining a well having an openable end; and a closure means for closing said openable end;

said openable end being bounded by at least one generally flexible sheet, said at least one sheet being extendable across said openable end to a covered position, said covered position presenting a first segment and a second segment of said at least one sheet in substantially abutting facing relationship across a generally planar expanse;

said closure means comprising at least one interference-fit structure within said expanse, each of said at least one interference-fit structure comprising an aperture-set, each said aperture-set including a first respective aperture in said first segment and a second respective aperture in said second segment, each of said first respective aperture and said second respective aperture having a tab means for effecting an interference fit, each said tab means presenting a free distal end depending within an associated aperture of said first respective aperture and said second respective aperture from a flex line, said flex line partially bounding said associated aperture, said first respective aperture and said second respective aperture in each said aperture-set being generally adjacently registrable in said covered position;

each of said at least one interference-fit structure being configured to hold said at least one sheet in said covered position by displacing said distal end of said tab means associated with each respective aperture of an aperture-set in a first direction generally laterally to said expanse sufficiently to extend each said distal end through at least an adjacent respective aperture of said aperture-set;

said first respective aperture having a first width and a first length and said second respective aperture having a second width and a second length, said first width and said second width being substantially equal;

said first length and said second length being substantially equal, and said flex line of said first respective aperture being offset from said flex line of said second respective aperture in said closed position along an axis, said axis being generally perpendicular to said flex line of said first respective aperture and to said flex line of said second respective aperture, whereby an enhanced interference fit is effected when said distal end of said tab means of said first respective aperture is displaced to extend through said second respective aperture.

2. A flexible package comprising:

a pouch means presenting a cavity for receiving contents, said pouch means having an openable end; and a closure means for closing said openable end; said openable end being bounded by a first sheet and a second sheet, said first sheet and said second sheet being generally flexible, said first sheet having a first outside face and a first inside face, said second sheet having a second outside face and a second inside face, said first sheet an said second sheet each having a first edge and a second edge, said first edges being joined by a first gusset, and said second edges being joined by a second gusset, each of said first gusset and said second gusset presenting a first panel and a second panel, said first panel terminating at said first sheet and extending to a fold line and said second panel terminating at said second sheet and extending to said fold line; said first sheet and said second sheet being extendable across said openable end to establish a covered position, said covered position presenting said first inside face and said second inside face in substantially abutting adjacent relationship across an expanse having a width along an axis extending generally perpendicularly from said first edge to said second edge and a height extending generally perpendicularly from said axis, said first gusset and said second gusset being foldingly sandwiched along said fold line intermediate said first sheet and said second sheet across a first gusset-area and a second gusset-area, said first gusset-area extending from said first edges along said axis a first panel-distance and said second gusset area extending from said second edges along said axis a second panel-distance, the sum of said first panel-distance and said second panel-distance being less than said width;

said closure means comprising at least one interference-fit means for establishing an interference fit to maintain said covered position, each of said at least one interference-fit means comprising an aperture-set, each said aperture-set comprising a first aperture in said first sheet and a second aperture in said second sheet; each of said first aperture and said second aperture having an associated tab means for effecting said interference fit, each said tab means having a distal end and depending from a flex line, each said flex line partially bounding its respective aperture;

each of said at least one interference-fit means being configured to maintain said first sheet and said second sheet in said covered position by displacing said distal end of said tab means associated with said first aperture in a direction generally oblique to said first sheet and said second sheet sufficiently to extend said distal end of said first aperture through said second aperture;

said closure means further comprising a crease line, said crease line being generally parallel t said axis and extending from said first edge to said second edge of each of said first sheet and said second sheet, and further comprising at least one additional interference-fit means, each of said at least one additional interference-fit means being configured substantially the same as said at least one interference-fit means; said at least one additional interference-fit means being arrayed in at least one interference-fit set, each said at least one interference-fit set comprising one each of said at least one interference-fit means and said at least one additional interference-fit means on opposing sides of said crease line;

said first sheet and said second sheet being convertible from said covered position to an enhanced covered position by folding along said crease line in a manner maintaining said first inside face in substantially abutting adjacent relationship while also presenting said second outside face in substantially abutting adjacent relationship with itself after said folding; each of said at least one interference-fit means and each of said at least one additional interference-fit means associated with a respective interference-fit set being substantially registrable in said enhanced covered position;

each of said at least one interference-fit set being configured to maintain said enhanced covered position by displacing said distal end associated with each aperture-set of each at least one interference-fit means in a direction generally oblique to said first sheet and said second sheet sufficiently to extend said distal end at least through the first encountered aperture of said at least one additional interference-fit means associated with a respective interference-fit set.

3. A flexible package as recited in claim 2 wherein said closure means further comprises a gusset interference-fit means in a respective gusset of at least said first gusset-area or said second gusset-area, each of said gusset interference-fit means comprising a gusset aperture-set, each said gusset aperture-set comprising a plurality of gusset-apertures including a first gusset-aperture in said first sheet, a second gusset-aperture in said first panel of said respective gusset, a third gusset-aperture in said second panel of said respective gusset, and a fourth gusset-aperture in said second sheet; said plurality of gusset-apertures being substantially registrable in said covered position; each of said plurality of gusset-apertures having an associated gusset-tab means, each said gusset-tab means having a free end depending from a gusset flex line, each said gusset flex line partially bordering a respective one of said plurality of gusset-apertures;

each of said at least one gusset interference-fit means being configured to maintain said covered position by displacing each respective said free end of each of said gusset-tab means of each of said plurality of gusset-apertures in a direction generally oblique to said first sheet and said second sheet sufficiently to extend each respective said free end at least through the next adjacent gusset-aperture.

4. A flexible package as recited in claim 2 wherein for each respective interference-fit set of said at least one interference-fit set, said one interference-fit means is displaced generally parallel with said axis with respect to said one additional interference-fit means, said displacement being appropriate to extend said distal end associated with said first aperture and said second aperture beyond said one additional interference-fit means, whereby an enhanced interference-fit is effected when said distal ends associated with said first aperture and said second aperture are displaced through said one additional interference-fit means.

5. A flexible package comprising a pouch means for receiving contents, said pouch means presenting an openable end, said openable end being bounded by a pair of opposing sheet members, said pair of sheet members being extendable over said openable end to a closing position, said pair of sheet members being in adjacent facing relationship in said closing position: said pouch means further including closure means, said closure means comprising at least one first aperture in a first sheet member of said pair of sheet members and at least one second aperture in a second sheet member of said pair of sheet members; each respective first aperture of said at least one first aperture having flexibly disposed therein a respective first tab depending from a first flex line partially bordering said respective first aperture, each said respective first tab having a first width and a first length; each respective second aperture of said at least one second aperture having flexibly disposed therein a respective second tab depending from a second flex line partially bordering said respective second aperture, each said respective second tab having a second width and a second length; said at least one first aperture and said at least one second aperture being arrayed in at least one aperture-pair in said closing position, each of said at least one aperture pair comprising one said respective first aperture and one said respective second aperture substantially in register; said respective first tab being displaceable through said respective second aperture of each of said at least one aperture-pair, thereby establishing an interference fit between said first sheet and said second sheet in said closing position;

said first width and said second width being substantially equal, said first length and said second length being substantially equal, and said first flex line being generally registered with a locus within said second aperture in said closing position, said locus being offset from said second flex line a distance less than one-half said first length.

6. A package comprising:

at least one wall defining a well having an openable end; and closure means for closing said openable end;

said openable end being bounded by at least one generally flexible sheet, said at least one sheet being extendable across said openable end to a covered position, said covered position presenting a first segment and a second segment of said at least one sheet in substantially abutting facing relationship across a generally planar expanse;

said closure means comprising at least one interference-fit structure within said expanse, each of said at least one interference-fit structure comprising an aperture-set, each said aperture-set including a first respective aperture in said first segment and a second respective aperture in said second segment, each of said first respective aperture and said second respective aperture having a tab means for effecting an interference fit, each said tab means presenting a free distal end depending within an associated aperture of said first respective aperture and said second respective aperture from a flex line, said flex line partially bounding said associated aperture, and first respective aperture and said second respective aperture in each said aperture-set being generally adjacently registrable in said covered position;

each of said at least one interference-fit structure being configured to hold said at least one sheet in said covered position by displacing said distal end of said tab means associated with each respective aperture of an aperture-set in a first direction generally laterally to said expanse sufficiently to extend each said distal end through at least an adjacent respective aperture of said aperture-set;

said first respective aperture having a first width and a first length and said second respective aperture having a second width and a second length, said first width and said second width being substantially equal;

said first length being at least equal to said second length, and said flex line of said first respective aperture being offset from said flex line of said second respective aperture in said closed position along an axis, said axis being generally perpendicular to said flex line of said first respective aperture and to said flex line of said second respective aperture, said offset being in a direction appropriate to extend said distal end of said tab means of said first respective aperture generally along said axis beyond said second respective aperture, whereby an enhanced interference fit is effected when said distal end of said tab means of said first respective aperture is displaced to extend through said second respective aperture.

7. A package comprising:

at least one wall defining a well having an openable end; and a closure means for closing said openable end;

said openable end being bounded by at least one generally flexible sheet, said at least one sheet being extendable across said openable end to a covered position, said covered position presenting a first segment and a second segment of said at least one sheet in substantially abutting facing relationship across a generally planar expanse;

said closure means comprising at least one interference-fit structure within said expanse, each of said at least one interference-fit structure comprising an aperture-set, each said aperture-set including a first respective aperture in said first segment and a second respective aperture in said second segment, each of said first respective aperture and said second respective aperture having a tab means for effecting an interference fit, each said tab means presenting a free distal end depending within an associated aperture of said first respective aperture and said second respective aperture from a flex line, said flex line partially bounding said associated aperture, said first respective aperture and said second respective aperture in each said aperture-set being generally adjacently registrable in said covered position;

each of said at least one interference-fit structure being configured to hold said at least one sheet in said covered position by displacing said distal end of said tab means associated with each respective aperture of an aperture-set in a first direction generally laterally to said expanse sufficiently to extend each said distal end through at least an adjacent respective aperture of said aperture-set;

said first respective aperture having a first width and a first length and said second respective aperture having a second width and a second length, said first width and said second width being substantially equal;

said first length being greater than said second length, and said flex line of said first respective aperture being generally in register with said flex line of said second respective aperture in said covered position, said distal end of said tab means of said first respective aperture extending beyond said second respective aperture, whereby an enhanced interference fit is effected when said distal end of said tab means of said first respective aperture is displaced to extend through said second respective aperture.

8. A flexible package comprising a pouch means for receiving contents, said pouch means presenting an openable end, said openable end being bounded by a pair of opposing sheet members, said pair of sheet members being extendable over said openable end to a closing position, said pair of sheet members being in adjacent facing relationship in said closing position; said pouch means further including closure means, said closure means comprising at least one first aperture in a first sheet member of said pair of sheet members and at least one second aperture in a second sheet member of said pair of sheet members; each respective first aperture of said at least one first aperture having flexibly disposed therein a respective first tab depending from a first flex line partially bordering said respective first aperture, each said respective first tab having a first width and a first length; each respective second aperture of said at least one second aperture having flexibly disposed therein a respective second tab depending from a second flex line partially bordering said respective second aperture, each said respective second tab having a second width and a second length; said at least one first aperture and said at least one second aperture being arrayed in at least one aperture-pair in said closing position, each of said at least one aperture-pair comprising one said respective first aperture and one said respective second aperture substantially in register; said respective first tab being displaceable through said respective second aperture of each of said at least one aperture-pair, thereby establishing an interference fit between said first sheet and said second sheet in said closing position;

said first width and said second width being substantially equal, said first length being greater than said second length, and said first flex line being generally registered with said second flex line in said closing position.

9. A flexible package comprising a pouch means for receiving contents, said pouch means presenting an openable end, said openable end being bounded by a pair of opposing sheet members, said pair of sheet members being extendable over said openable end to a closing position, said pair of sheet members being in adjacent facing relationship in said closing position; said pouch means further including closure means, said closure means comprising at least one first aperture in a first sheet member of said pair of sheet members and at least one second aperture in a second sheet member of said pair of sheet members; each respective first aperture of said at least one first aperture having flexibly disposed therein a respective first tab depending from a first flex line partially bordering said respective first aperture, each said respective first tab having a first width and a first length; each respective second aperture of said at least one second aperture having flexibly disposed therein a respective second tab depending from a second flex line partially bordering said respective second aperture, each said respective second tab having a second width and a second length; said at least one first aperture and said at least one second aperture being arrayed in at least one aperture-pair in said closing position, each of said at least one aperture-pair comprising one said respective first aperture and one said respective second aperture substantially in register; said respective first tab being displaceable through said respective second aperture of each of said at least one aperture-pair, thereby establishing an interference fit between said first sheet and said second sheet in said closing position;

said first width and said second width being substantially equal, said first length being greater than said second length, and said first flex line being generally registered with a locus within said second aperture in said closing position, said locus being displaced from said second flex line a distance less than one-half said first length.

* * * * *